US007658202B2

(12) United States Patent
Mueller et al.

(10) Patent No.: US 7,658,202 B2
(45) Date of Patent: Feb. 9, 2010

(54) LOW-PROFILE VALVE ASSEMBLY

(75) Inventors: Jeffrey L. Mueller, Plymouth, WI (US); Terrence J. Andersen, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 484 days.

(21) Appl. No.: 11/801,005

(22) Filed: May 8, 2007

(65) Prior Publication Data

US 2008/0277003 A1 Nov. 13, 2008

(51) Int. Cl.
*E03C 1/04* (2006.01)

(52) U.S. Cl. ..... 137/315.12; 137/359

(58) Field of Classification Search ..... 137/315.12, 137/359, 801; 4/677
See application file for complete search history.

(56) References Cited

U.S. PATENT DOCUMENTS 4,463,460 A * 8/1984 Arnold et al. ..... 4/678
4,747,428 A * 5/1988 Crawford et al. ..... 137/315.12
5,257,645 A 11/1993 Scully et al.
6,014,985 A 1/2000 Warshawsky
6,220,279 B1 4/2001 Segien
6,301,728 B1 10/2001 Pilatowicz et al.
6,345,643 B1 * 2/2002 Ko ..... 137/315.12
6,370,712 B1 4/2002 Burns et al.
6,421,849 B1 7/2002 Gray
6,434,765 B1 8/2002 Burns et al.
6,684,906 B2 2/2004 Burns et al.
6,757,921 B2 7/2004 Esche
6,871,669 B2 3/2005 Meyer et al.
7,080,665 B2 7/2006 Whall
7,163,022 B2 1/2007 Whall
7,374,212 B1 * 5/2008 Gretz ..... 285/382.7
2004/0231049 A1 * 11/2004 Meeder ..... 4/695

FOREIGN PATENT DOCUMENTS

EP 1479836 A2 11/2004
JP 09144949 6/1997

OTHER PUBLICATIONS

PCT/US2008/005049, International Search Report and Written Opinion; 12 pages.

* cited by examiner

*Primary Examiner*—Kevin L Lee
(74) *Attorney, Agent, or Firm*—Quarles & Brady LLP

(57) ABSTRACT

Disclosed are low-profile valve assemblies for engaging a counter top or other mounting surface having a through opening. A special collar is provided which has a flange facing the outer surface of the mounting surface, and a skirt that extends into the through opening where the inward portion of the skirt connects to the valve body. This insets the valve body. o-ring and recess structures are provided to seal the construction, and a handle has an outer skirt to hide the collar.

9 Claims, 5 Drawing Sheets

LOW-PROFILE VALVE ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to valve assemblies mountable to a surface such as a counter top or a wall. More particularly it relates to structures that permit insetting of the usual valve control stem so that the overall design can have a lower/inset profile once a handle is attached to the valve stem.

U.S. Pat. No. 6,014,985 discloses a valve mounted to a counter top in a conventional manner. There is an elongated cylindrical valve body with threads on its outer radial periphery, a mounting collar that threads down on the body periphery to a desired position where the collar abuts the counter top, and a valve control stem projecting up through the collar.

However, once a control handle is linked to the valve stem the final design will have the handle considerably upward/outward from the support surface. This places some ornamental constraints, and in any event may be problematic functionally when the valve is mounted through a vertical wall in a compact shower enclosure.

Apart from ornamental and space constraints, it is important that whatever assembly is used adequately seal the opening through the support surface. For example, one wants to prevent water from a shower leaking out the wall opening behind the enclosure. This is a complicating factor in designing valve assemblies.

Traditional valve assemblies often rely on caulk which can be ornamentally undesirable in some cases. Other traditional assemblies incorporate o-ring seals at positions where the seal may wear.

Hence, a need exists for a valve assembly that provides a lower profile appearance for a given type of handle, while also providing a watertight assembly.

SUMMARY OF THE INVENTION

The present invention provides a valve assembly mountable through a mounting surface having an opening there through. The valve assembly has an elongated valve body having an internal bore mounting a control valve such that a valve control stem projects out of the valve body. The valve body also has a radially outer threaded periphery.

There is also a collar having a flange extending essentially radially outward and a skirt extending axially away from the flange. The skirt has threads adjacent a position axially remote from the flange which are suitable to mate with the radially outer threaded periphery of the elongated valve body.

A handle is mounted to the valve control stem to control movement thereof. The collar is suitable to mount the valve body to the mounting surface, with the flange facing an outward facing surface of the mounting surface while the skirt extends into the opening.

In preferred forms the flange is in the form of a circumferential ring or a plurality of tabs, the handle has a handle arm and an ornamental escutcheon for hiding the collar, and the collar has a threaded portion for coupling to the ornamental escutcheon. For example, the collar's upper portion may have internal or external threads for coupling to the ornamental escutcheon.

In another preferred form there is an o-ring between the collar and the valve body (preferably in a recess). Also, the control valve may be threaded into the internal bore of the valve body, and the control valve may be in the form of a valve cartridge.

It should be appreciated that these assemblies permit the elongated valve body to be hung down farther lower/inward relative to the supporting wall, with the result that the control stem (and thus the control handle) project out less far. This has a sleeker ornamental appearance, and also helps maximize available room in compact shower stalls.

Nevertheless, means are provided to provide a watertight assembly. Further, the assembly is such that it can be easily taken apart for servicing or maintenance. Moreover, the specified parts of the assembly central to these advantages do not add significant additional cost to the final product.

These and still other advantages of the present invention will be apparent from the detailed description and drawings. What follows are merely example preferred embodiments of the present invention. To assess the full scope of the invention the claims should also be looked to.

DETAILED DESCRIPTION OF THE PREFERRED EMBODIMENTS

The drawings depict valve assemblies mounted on conventional counter tops. However, the present invention is mountable on horizontal plumbing fixtures themselves (e.g. through a top rim of a bathtub or sink), or on a vertical wall. Hence, the term "mounting surface" should be interpreted accordingly.

Figure 1:
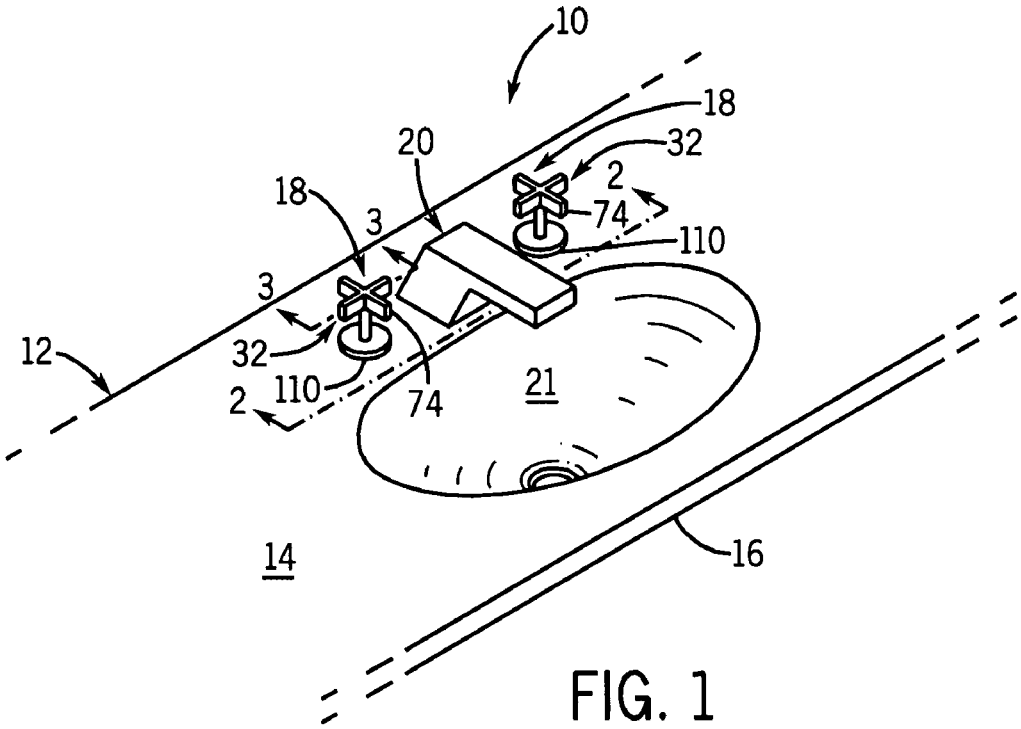
FIG. 1 is a perspective view of a plumbing fixture mounted on a counter top, where the fixture incorporates valve assemblies of the present invention.

Referring now to FIG. 1, there is shown a deck mounted widespread type faucet 10 positioned on mounting surface/counter top 12, having an upper facing 14 and a bottom surface 16. The faucet 10 includes a pair of essentially identical valve assemblies 18 (albeit typically with the valves set for reverse rotation relative to each other) plumbed to a centrally mounted spout 20.

Figure 2:
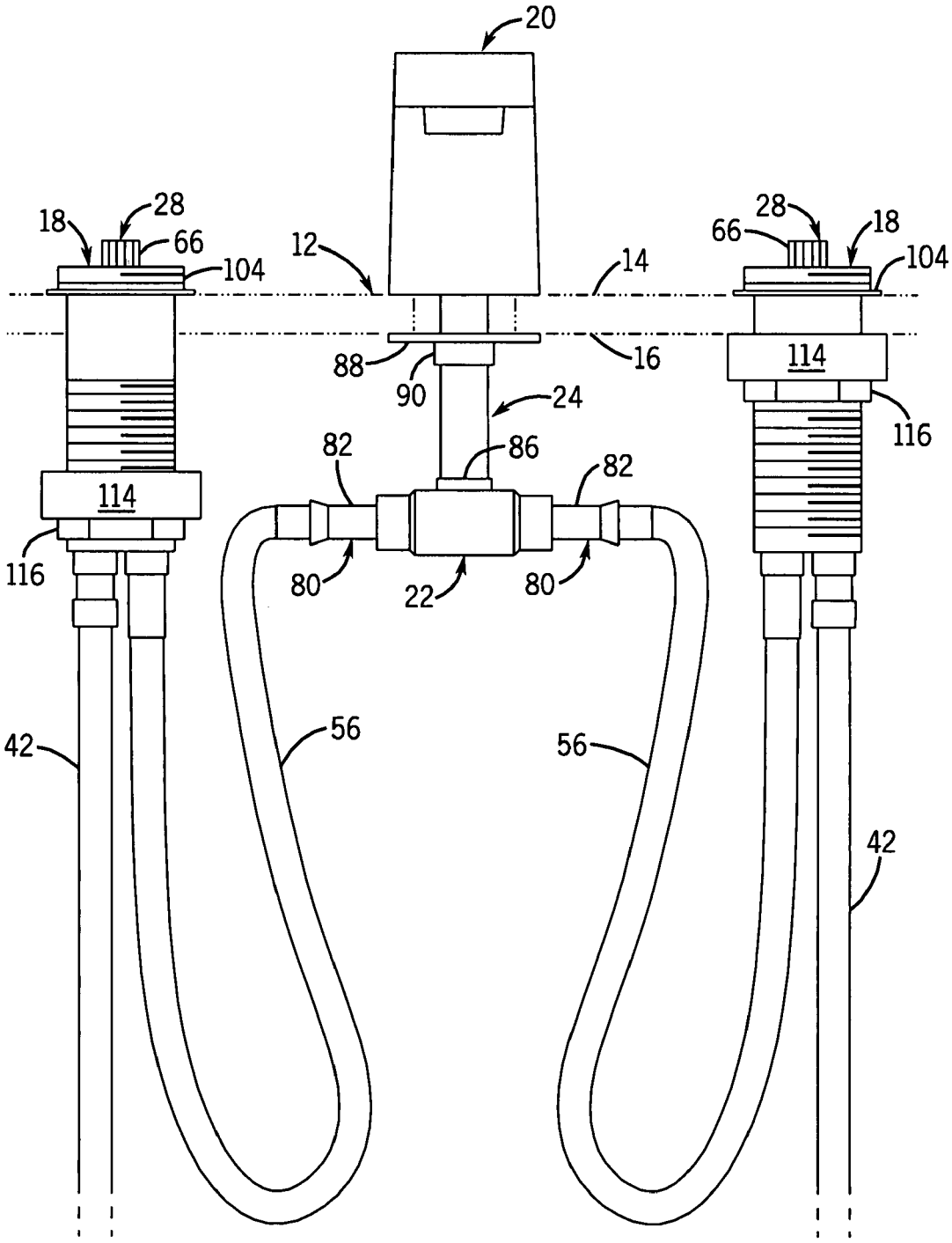
FIG. 2 is a view taken along line 2-2 of FIG. 1.

As best understood from FIG. 2, one valve assembly 18 is plumbed to a hot water supply and the other to a cold water supply. Both valve assemblies 18 are plumbed to a central mixing tee 22. Hence, when both valves are open, the hot and cold water mix in the mixing tee 22 and then flow up a neck 24 and exit through the spout 20 into a plumbing fixture such as basin 21 (shown in FIG. 1).

Figure 3:
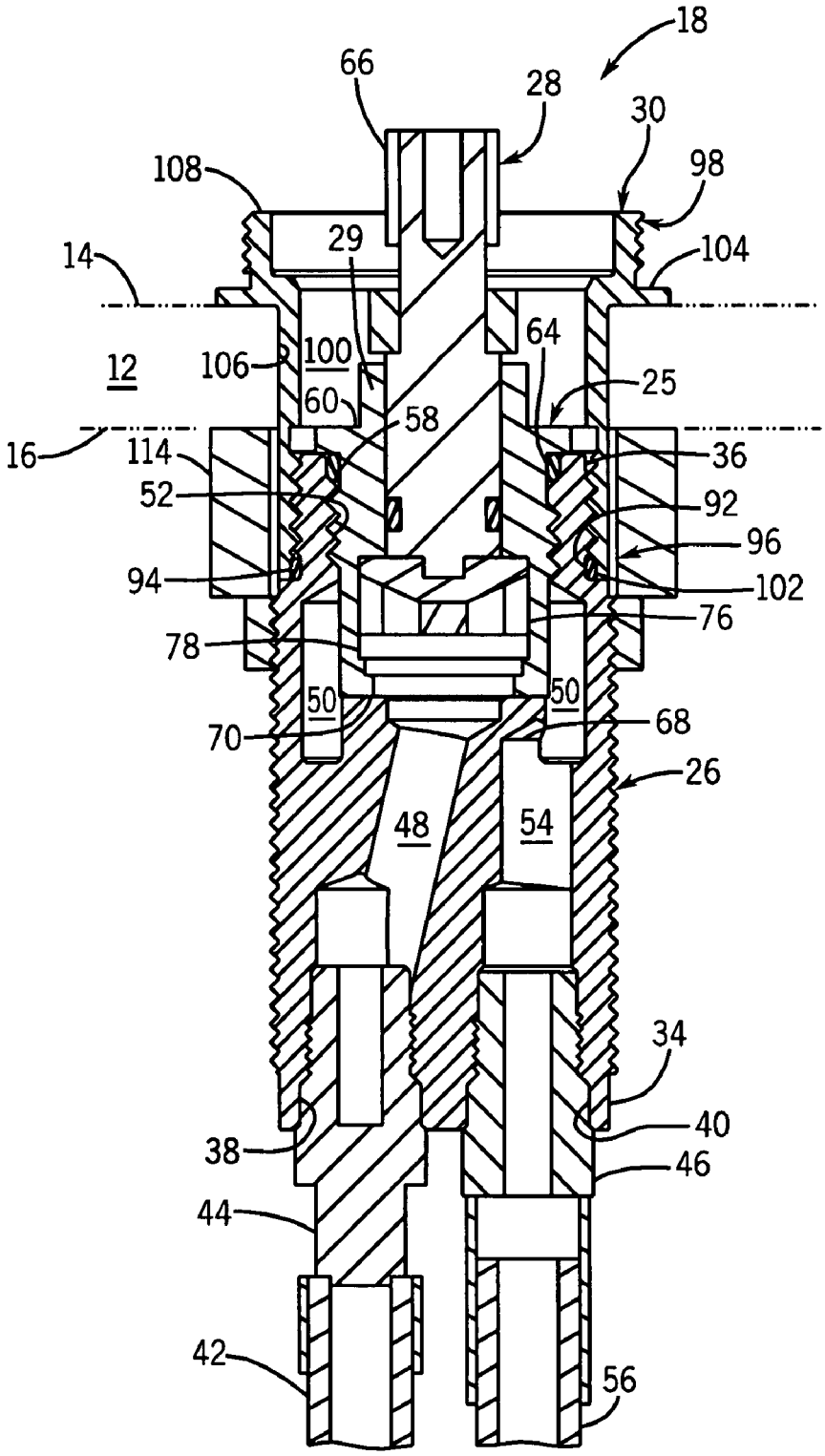
FIG. 3 is a cross-sectional view taken along line 3-3 of FIG. 1.

Considering now FIGS. 1-3, both valve assemblies 18 include a valve 25 with an elongated valve body 26 and a valve cartridge 29. Most importantly there is also now a collar 30 coupled to the valve body 26. There is also a handle 32 which includes the usual arm or arms 74, ornamental skirt 110, and a connecting region there between. Note that the skirt 110 is suitable to hide the collar 30 and valve stem 28 in the final assembly, while permitting rotation of the handle arm or arms to drive the valve stem 28.

With additional reference to FIG. 3, the elongated valve body 26 is generally cylindrical and has a lower portion 34 and an upper portion 36. The lower portion 34 includes a supply hose receptacle 38 and a delivery hose receptacle 40. Each receptacle 38, 40 includes a countersunk, internally threaded bore for receiving the mating threads of a supply hose fitting 44 and delivery hose fitting 46, respectively.

The supply hose receptacle 38 leads to an angled, cylindrical supply passageway 48. The supply passageway 48 is angled towards the center of the valve body 26 and terminates in a flared opening at a central chamber 50. The chamber 50 is formed by a central bore 52 formed in the upper portion 36. The bore 52 is partially threaded to mate with the valve cartridge 29 (described below). A delivery passageway 54 extends from the chamber 50 to the lower portion 34 of the valve body 26 where it terminates at the deliver hose receptacle 40.

A standard valve cartridge 29 is used to control the flow of liquid from the supply hose 42, coupled to the supply hose receptacle 38, to a delivery hose 56, coupled to the delivery hose receptacle 40. The central bore 52 of the valve body 26 includes a beveled opening 58 adjacent internal threads for engaging external threads on the valve cartridge 29.

The valve cartridge 29 is threaded into the bore 52 until an annular flange 60 compresses an o-ring 64 located between the annular flange 60 and the beveled opening 58 of the valve body 26. This sealing interface is to prevent fluid from flowing out the valve body 26 past the valve cartridge 29 and leaking from the valve assembly 18.

A gasket 68 is forced into engagement with a valve seat 70 of the valve body 26. The sealing interface between the gasket 68 and the valve seat 70 is to prevent fluid from flowing from the supply passageway 48 to the delivery passageway 54 when the valve cartridge 29 is in the closed position.

The valve cartridge 29 includes a knurled valve stem 66 extending upwards. The valve stem 66 is inserted into a mating knurled bore (not shown) of the handle 74. Rotating the attached handle arms 74 therefore rotates the valve stem 66 and an attached valve disk 76, metering the flow of water through the valve body 26.

The circular valve disk 76 has an hourglass shaped cross-section that rotates about a stationary hourglass shaped plate 78. When the valve disk 76 and the plate 78 are aligned, the valve cartridge 29 is wide open, and when the valve disk 76 and the plate 78 are completely offset, the valve cartridge 29 is closed and no fluid flows through the cartridge. Both the valve disk 76 and the plate 78 are preferably made of ceramic, but may be made from any suitable material such as plastic. The present invention is applicable to many other types of valves as well, including, for example, gate valves and globe valves.

Opening the valve cartridge 29 allows fluid to flow from the upstream, higher pressure supply hose 42 and into the supply passageway 48. Fluid passes from the supply passageway 48, into the chamber 50, and flows through the delivery passageway 54 into the delivery hose 56. The remaining end of the delivery hose 56 is coupled to the mixing tee 22 via, preferably, a quick-connect fitting assembly 80. The fitting assembly 80 includes a female nylon coupler 82 into which a male nipple (not shown) is secured. Alternatively, the mixing tee 22 and delivery hoses 56 may be plumbed by any conventional manner.

The mixing tee 22 has a threaded central outlet bore 86 to which the neck 24 is threaded. Fluid flows through the neck and out the spout 20 into the basin 21. The neck extends through an aperture formed in the mounting surface 12 and is secured into the spout 20. The spout 20 is placed on the mounting surface 14 of the mounting surface 12 and coupled to the mounting surface 12 by an installation washer 88 slid over the neck 24 and a nut 90. The nut 90 engages mating threads on the outside of the neck 24 and sandwiches the mounting surface 12 between the spout 20 and the washer 88.

Figure 4:
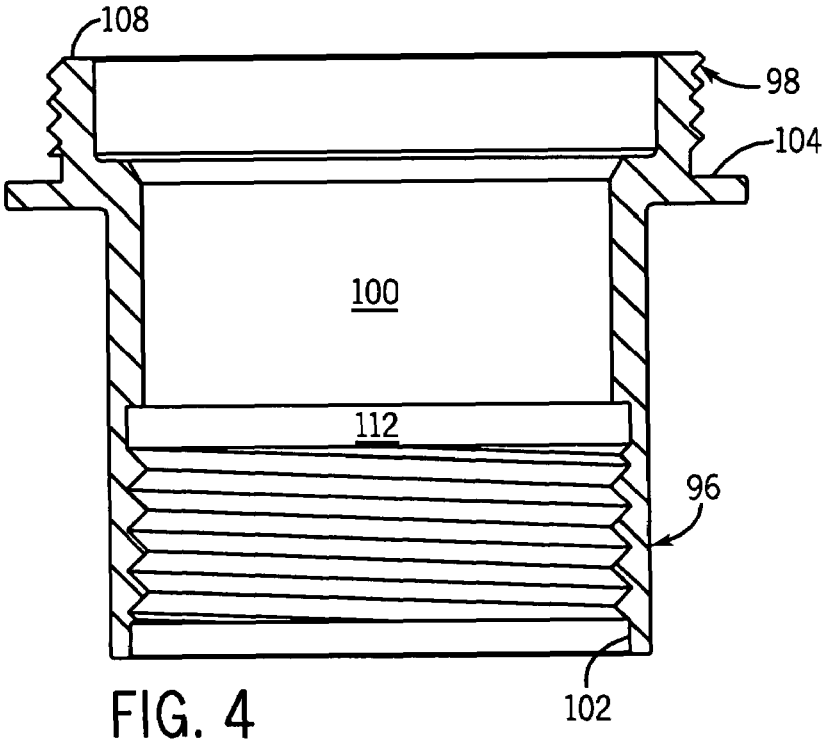
FIG. 4 is an enlarged cross-sectional view of the FIG. 3 collar.

Returning to the valve assemblies 18 and FIGS. 2, 3, and 4, upper portion 36 of the valve body 26 is threaded and coupled to a collar 30. The upper portion 36 includes an annular recess 92 preferably near the base of the upper portion 36 to accommodate a seal 94, such as an o-ring. The recess 92 and seal 94, however, may be formed at other locations along the interface between the valve body 26 and the collar 30.

The diameter of the upper portion 36 is slightly less than the diameter of the lower portion 34, allowing a portion of the collar 30 to extend beyond the threaded upper portion 36 of the valve body 26 and engage the seal 94. This engagement prevents fluid from flowing between the collar 30 and the valve body 26, and under the faucet 10 of the example embodiment.

The collar 30 is a generally cylindrical sleeve having a lower portion 96 and an upper portion 98. The lower portion 96 includes a partially threaded bore 100. The bore 100 mates with the exterior threads on the smaller diameter upper portion 36 of the valve body 26. The lower portion 96 has a non-threaded, lip 102 for interfacing with the valve body 26. As the collar 30 is mated with the valve body 26, the seal 94 located in the recess 92 of the valve body 26 is compressed by the lip 102 of the collar 30. If the valve cartridge 29 were to leak, the fluid would accumulate in the bore 100 of the collar 30 versus flow around the valve body 26 and under the faucet 10. Once the bore 100 is full, the fluid would breach the upper portion 98 and flow onto the mounting surface 14 of the mounting surface 12 where it is easily acknowledged and corrected.

Turning to the upper portion 98 of the collar 30, an annular flange 104 is shown protruding outwardly. The annular flange 104 is configured to be larger than an opening 106 formed in the mounting surface, here the mounting surface 12, so that the flange 104 rests on the mounting surface 14 and supports the valve body 26 and valve cartridge 29. The upper portion 98, above the flange 104, includes a lip 108 having a threaded outer surface for securing mating threads of the handle fitting 32 (e.g., handle 74 or bonnet 110).

It is important to note that the bonnet 110 does not support the valve body 26 or valve cartridge 29. Instead, the collar 30 engages the mounting surface 12 by inserting a portion of the collar 30 into the opening 106 formed in the mounting surface 12 until the flange 104 engages the mounting surface 14. In the example embodiment, the collar 30 extends through the mounting surface 12 and beyond the bottom surface 16. However, depending upon collar 30 size and mounting surface 12 thickness, the collar 30 may not extend fully through the mounting surface 12.

The bore 100 further includes a stop, here a groove 112, establishing a limit on how far the valve body 26 can be threaded into the collar 30. Overall, the collar 30 allows the valve body 26 and coupled valve cartridge 29 to be mounted beneath the mounting surface 14 of the example embodiment allowing for use of a sleeker, smaller handle fitting 32.

The flange 104, while illustrated in the example embodiment as an annular flange extending around the entire perimeter of the collar 30, may instead be a series of tabs or any similar structure used to engage the mounting surface 12.

Figure 5:
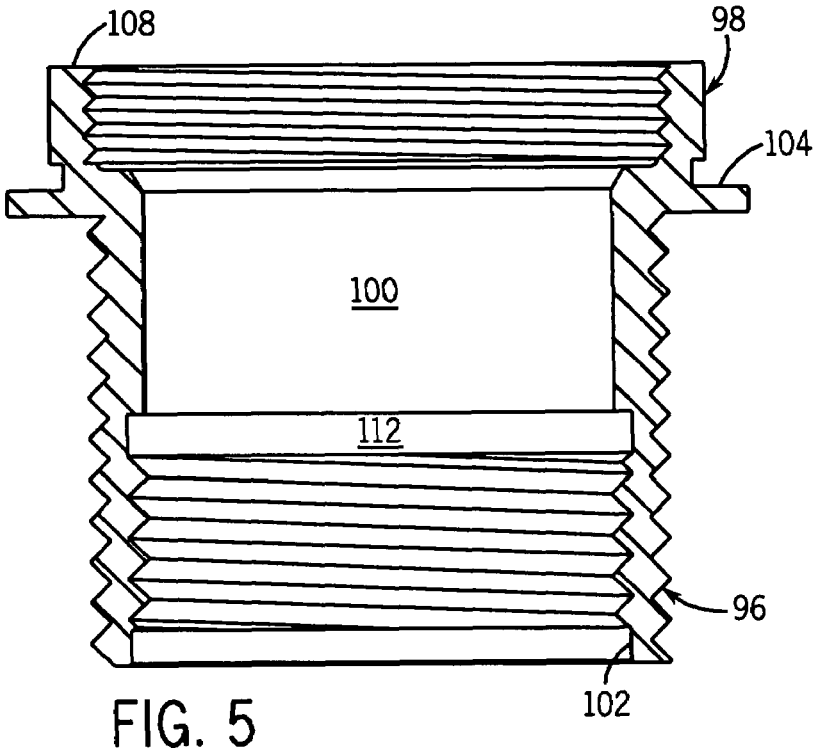
FIG. 5 is a view similar to FIG. 4, but of an alternative form of the collar.

During installation of the valve assembly 18, a cylindrical spacer 114 is slid over the valve body 26 and collar 30 until it abuts the bottom surface 16 of the mounting surface 12. An installation nut 116, or fastener, is then threaded onto the mating threads of the valve body 26, forcing the flange 104 of the collar 30 and the spacer 114 to sandwich the mounting surface 12. A spacer 114 and nut 116 are shown in the loosened position on the left valve assembly 18 of FIG. 2 and in the tightened position on the right valve assembly 18 of FIG. 2.

Where the mounting surface 12 is slightly thicker than the collar 30, the spacer 114 is not required as the installation nut 116 abuts the bottom surface 16 of the mounting surface 12 directly. Alternatively, the lower portion 96 of the collar 30 may also include external threads as shown in FIG. 5. The installation nut 116 may then be threaded directly to the collar 30 and mounts the valve assembly 18 to the mounting surface 12.

The valve body 26 and collar 30 are preferably machined from brass, but may be made of any suitable material, including plastic. The o-ring 64, gasket 68, and seal 94 may be made from rubber, silicone, plastic, or any other suitable material.

Figure 7:
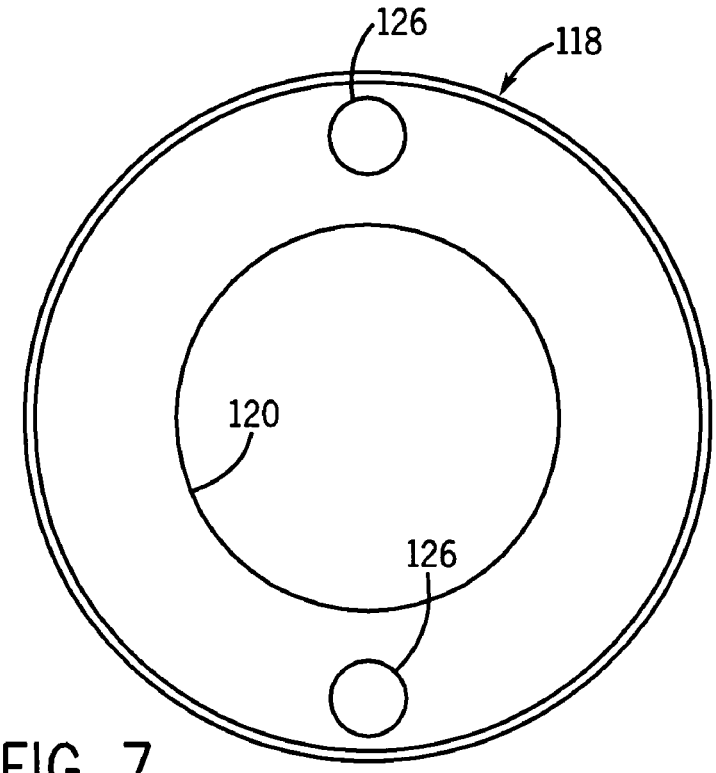
FIG. 7 is a top view of support ring 126 of the FIG. 6 embodiment.
Figure 6:
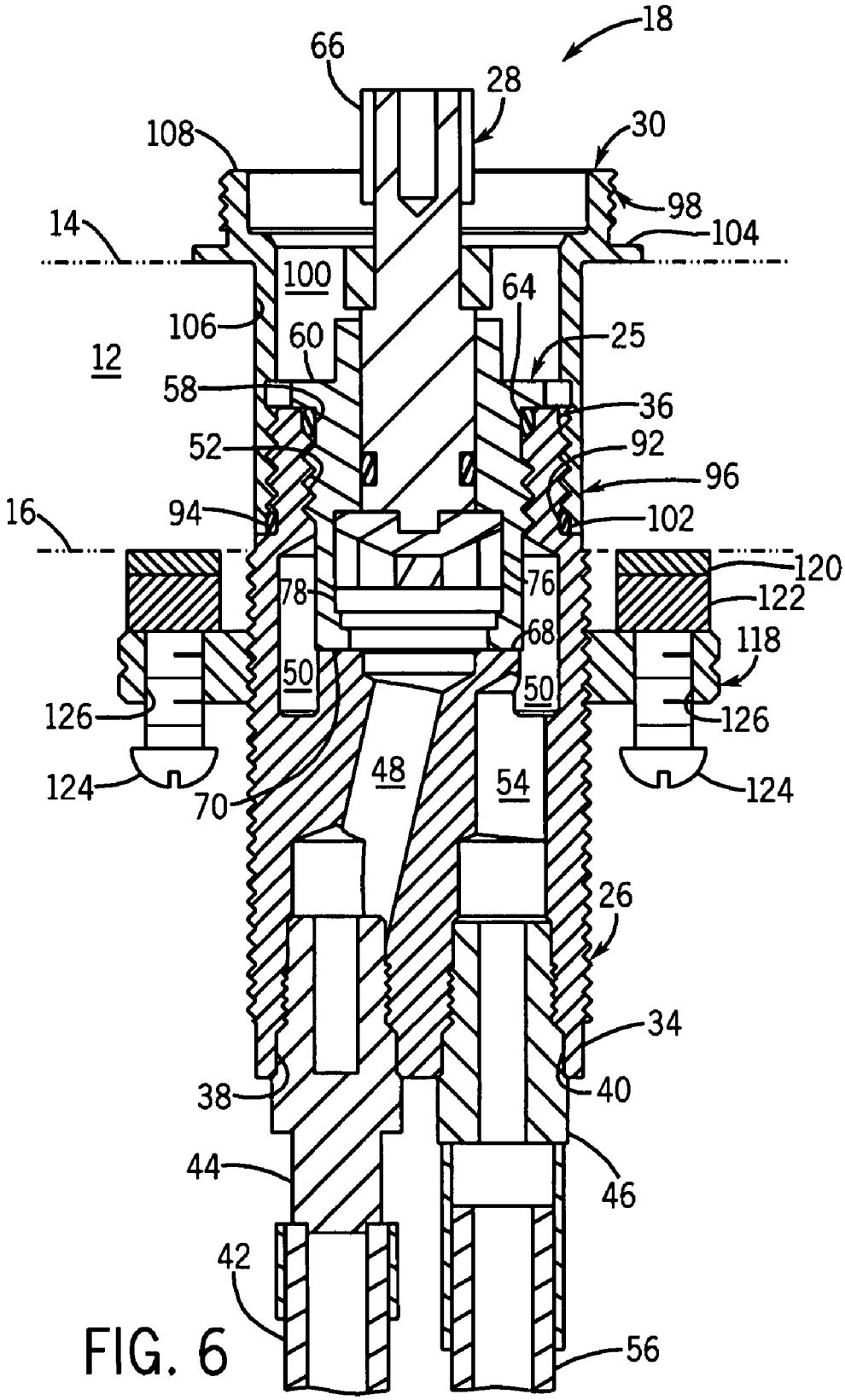
FIG. 6 is a view similar to FIG. 3, but of another embodiment of the valve assembly.

With reference to FIGS. 6 and 7, the parts are similar to those used in the FIG. 3 embodiment but for the clamping system below the counter top. In this regard, there is a support ring 118 threaded to the valve body 26 to provide improve stability to the valve assembly 18 during installation and use. After inserting the valve body 26 into the opening 106 a fiber washer 120 and metal washer 122 are slid over the valve body 26.

The support ring 118 is then threaded onto the valve body 26. A pair of screws 124 are partially threaded into a pair of threaded holes 126 spaced one hundred and eighty degrees apart formed through the support ring 118. Once the valve body 26 and collar 30 are aligned as desired, the screws 124 are tightened, urging the metal washer 122 and protective fiber washer to engage the bottom surface 16 of the mounting surface 12. This interaction helps to prevent the valve assembly 18 from rotating away from the desired orientation during installation and use of the faucet 10.

It should be appreciated that a preferred embodiment of the invention has been described above and depicted in the enclosed drawings. However, many modifications and variations to the preferred embodiments will be apparent to those skilled in the art, which will be within the spirit and scope of the invention. For example, the collar 30 may include internal threads on the upper portion 98 for engaging the bonnet 110 or handle 74.

Therefore, the invention should not be limited to just the described embodiments. To ascertain the full scope of the invention, the following claims should be referenced.

INDUSTRIAL APPLICABILITY

The invention provides a low-profile valve assembly for engaging a mounting surface of a mounting surface.

We claim:

1. A valve assembly mountable through a mounting surface that has an opening there through, the valve assembly comprising:

an elongated valve body having an internal bore mounting a control valve such that a valve control stem projects out of the valve body, wherein the elongated valve body also has a radially outer threaded periphery;

a collar having a flange extending essentially radially outward and a skirt extending axially from the flange, the skirt having threads adjacent a position axially remote from the flange which are suitable to mate with the outer threaded periphery of the elongated valve body, and the collar having an upper portion above the flange having radially directed threads thereon; and a handle mountable to the control stem to control movement thereof;

wherein the collar is suitable to mount the valve body to the mounting surface with the flange facing an outward facing surface of the mounting surface while the skirt extends into the opening.

2. The valve assembly of claim 1, wherein the flange is in a form of a circumferential ring.

3. The valve assembly of claim 1, wherein the flange is in a form of a plurality of tabs.

4. The valve assembly of claim 1, wherein the handle comprises an arm and an ornamental escutcheon linked to the arm for hiding the collar.

5. The valve assembly of claim 4, wherein the collar has an externally threaded portion for coupling to the ornamental escutcheon.

6. The valve assembly of claim 4, wherein the upper portion of the collar has internal threads for coupling to the ornamental escutcheon.

7. The valve assembly of claim 1, wherein there is an o-ring between the collar and the valve body.

8. The valve assembly of claim 1, wherein a control valve is threaded into the internal bore of the valve body, and the control valve is in a form of a valve cartridge.

9. A valve assembly mountable through a mounting surface that has an opening there through, the valve assembly comprising:

an elongated valve body having an internal bore mounting a control valve such that a valve control stem projects out of the valve body, wherein the elongated valve body also has a radially outer threaded periphery;

a collar having a flange extending essentially radially outward and a skirt extending axially from the flange, the skirt having threads adjacent a position axially remote from the flange which are suitable to mate with the outer threaded periphery of the elongated valve body; and a handle mountable to the control stem to control movement thereof;

wherein the collar is suitable to mount the valve body to the mounting surface with the flange facing an outward facing surface of the mounting surface while the skirt extends into the opening, wherein the collar includes external threads.

* * * * *